US011193669B2

(12) United States Patent
Bell et al.

(10) Patent No.: US 11,193,669 B2
(45) Date of Patent: Dec. 7, 2021

(54) HEAT EXCHANGER

(71) Applicant: ConleyMax Inc., Calgary (CA)

(72) Inventors: Patrick G. Bell, Calgary (CA); William N. Beckie, Calgary (CA)

( * ) Notice: Subject to any disclaimer, the term of this patent is extended or adjusted under 35 U.S.C. 154(b) by 233 days.

(21) Appl. No.: 16/214,801

(22) Filed: Dec. 10, 2018

(65) Prior Publication Data

US 2019/0107276 A1 Apr. 11, 2019

Related U.S. Application Data

(63) Continuation of application No. 14/042,211, filed on Sep. 30, 2013, now Pat. No. 10,190,765.

(51) Int. Cl.

| | |
|---|---|
| ***F22B 1/16*** | (2006.01) |
| ***F28D 1/02*** | (2006.01) |
| ***B65D 88/74*** | (2006.01) |
| ***F24H 1/22*** | (2006.01) |
| ***F24H 1/20*** | (2006.01) |
| ***F28D 1/047*** | (2006.01) |
| ***F24H 9/18*** | (2006.01) |

(52) U.S. Cl.

CPC ..... *F22B 1/167* (2013.01); *B65D 88/74* (2013.01); *F24H 1/208* (2013.01); *F24H 1/22* (2013.01); *F24H 9/1809* (2013.01); *F28D 1/0213* (2013.01); *F28D 1/0475* (2013.01)

(58) Field of Classification Search

CPC ..... F28D 1/0475; F28D 1/0213; F28D 1/208; F28D 1/22; B65D 88/74; F24H 9/1809; F22B 1/167

See application file for complete search history.

(56) References Cited

U.S. PATENT DOCUMENTS

| | | | | |
|---|---|---|---|---|
| 1,987,182 | A * | 1/1935 | Dalen | F24H 1/0009 122/33 |
| 3,109,414 | A | 11/1963 | McClanahan | |
| 3,133,590 | A | 5/1964 | Lowe | |
| 3,633,658 | A | 1/1972 | Kirschner | |
| 3,937,276 | A | 2/1976 | Ostwald | |
| 4,173,872 | A | 11/1979 | Franklin | |
| 4,296,799 | A | 10/1981 | Steele | |
| 4,328,683 | A | 5/1982 | Whitesides | |

(Continued)

FOREIGN PATENT DOCUMENTS

| | | |
|---|---|---|
| CA | 2235554 A1 | 10/1998 |
| CN | 201599938 U | 10/2010 |

(Continued)

OTHER PUBLICATIONS

Notification of Transmittal of Translation of Int'l Preliminary Amendment Report on Patentability (Forms PCT/IB/326) of Int'l App. No. PCT/CA2014/050920, dated Apr. 5, 2016 with Form PCT/IB/237 and PCT/IB/373. (6 pages).

(Continued)

*Primary Examiner* — Steven S Anderson, II

(74) *Attorney, Agent, or Firm* — HEA Law PLLC; Darrin E. Auito

(57) ABSTRACT

A method of connecting a heat exchanger, which is used primarily in oil and gas operations to heat tanks of liquids, such as drilling mud, water, heavy oil or other such fluids from freezing or becoming too viscous to pump, to a tank.

16 Claims, 2 Drawing Sheets

(56) References Cited

U.S. PATENT DOCUMENTS

| | | | | | |
|---|---|---|---|---|---|
| 4,492,093 | A * | 1/1985 | Schwarz | F24D 3/08 | 62/238.6 |
| 4,497,365 | A | 2/1985 | Boyer | | |
| 5,353,653 | A * | 10/1994 | Watanabe | F22D 1/325 | 165/11.1 |
| 6,612,268 | B1 * | 9/2003 | Peteri | F24H 1/182 | 122/19.2 |
| 2008/0142609 | A1 * | 6/2008 | Lissner | B60H 1/00364 | 237/19 |
| 2013/0145996 | A1 | 6/2013 | Cooper et al. | | |

FOREIGN PATENT DOCUMENTS

| | | | |
|---|---|---|---|
| CN | 201652812 | U | 11/2010 |
| CN | 202350316 | * | 7/2012 |
| CN | 202350316 | U | 7/2012 |
| EP | 0259895 | A1 | 3/1988 |
| EP | 2317240 | A2 | 5/2011 |

OTHER PUBLICATIONS

Int'l Search Report of PCT/CA2014/050920, dated Dec. 8, 2014.

Notification of Transmittal of Int'l Search Report (form PCT/ISA/220) and Written Opinion of the Int'l Searching Authority (form PCT/ISA/237) of Int'l App. No. PCT/CA2014/050920, dated Dec. 8, 2014 (8 pages).

Cooper Tube Coil Immersion Heat Exchanger; Finned Tube Coil Immersion Heat Exchanger, Product Description (online). Smartclima Corporation, Sep. 22, 2013, (retrieved on Nov. 27, 2014). Retrieved from the Internet: https://web.archive.org/web/20130922170627 /http://www.smartclima.com/category/heat-exchanger.

Notice of Allowance dated Nov. 21, 2014, issued in corresponding Canadian Patent App. No. 2828939 (1 page).

Canadian Office Action dated Jun. 10, 2014, issued in corresponding Canadian Patent App. No. 2,828,939 (2 pages).

Canadian Office Action dated Feb. 10, 2014, issued in corresponding Canadian Patent App. No. 2,828,939 (2 pages).

* cited by examiner

HEAT EXCHANGER

CROSS-REFERENCE TO RELATED APPLICATIONS

This application claims priority to and is a continuation of pending U.S. application Ser. No. 14/042,211 filed on Sep. 30, 2013. The contents of the above document is incorporated herein by reference in its entirety.

BACKGROUND

This invention generally relates to using a heat exchanger to prevent a tank containing liquid from freezing or to maintain the temperature of the liquid in a tank at a desired temperature.

Certain industrial applications require large volumes of heated fluid, primarily water, but not excluding other fluids such as drilling mud, hydrocarbons or caustic solutions. Although this patent application is not limited to any one of these types of fluids, this application will refer to these fluids as water. Also, although many types of fluids, such as glycol and oil, may be used as a heat generator fluid, this application will refer to glycol as the heat generator fluid.

Specific environments, such as that of the energy industry, may require that an open flame not be present. The fluid heating system and process described herein was created to heat fluids in such environments.

Common practice, for example, has been to truck water to several tanks located at the site of an oil or gas well. The water is typically heated by open flamed trucks which utilize, for example, diesel, natural gas or propane fired burners. However, these burners are inefficient (e.g., utilizing excessive amounts of fuel) and hazardous (e.g., causing fires, severe burns, and fatalities).

A flameless heat exchanger system removes these hazards by circulating hot glycol (e.g., temperature less than 100 degrees Celsius) within the tank, and returning it to the heat source. There is no risk of explosion or burns due to open flames or high temperature steam.

The heat exchanger may be installed by inserting it into a flanged opening (e.g., four inches in diameter) in the tank, when the tank is empty. Although a four inch flange is a standard size in the oil and gas industry, the heat exchanger can be any size, and can be inserted in any size of opening. When the tanks are filled, a heater is moved to the tank site, connected to the heat exchanger, and heats the water, or any other fluid contained in the tanks, to a desired temperature. The heater generates hot glycol, which is pumped to the tanks, circulated through the heat exchanger, and returned to the heater.

This process may be continuous (or interrupted) and may be continued, for example, until the fluid in the tank is heated to the desired temperature. Multiple tanks can be heated, for example, by connecting them in series with hoses and quick connect couplers or with the use of a manifold and connected in parallel. The heating process is efficient and safe.

SUMMARY

One aspect of the present invention includes a heat transfer tube, a flange, and quick connect adaptors. The heat transfer tube is configured such that the length of the tube is long enough to provide maximum amount of heating area within the tank, yet shorter than the diameter of the tank. The tube may be configured to include one or more bends and differing lengths or tubing, depending on the tank flange size. The flange is configured to have approximately the same diameter as the tank flange, which can be any size required for the tank. Quick connect adapters may be used so that hoses (e.g., which supply the glycol) can be quickly coupled and uncoupled from the heat exchanger, which are providing the hot glycol.

BRIEF DESCRIPTION OF THE DRAWINGS

The following drawings illustrate examples of various components of the invention disclosed herein, and are for illustrative purposes only.

DETAILED DESCRIPTION

Figure 1:
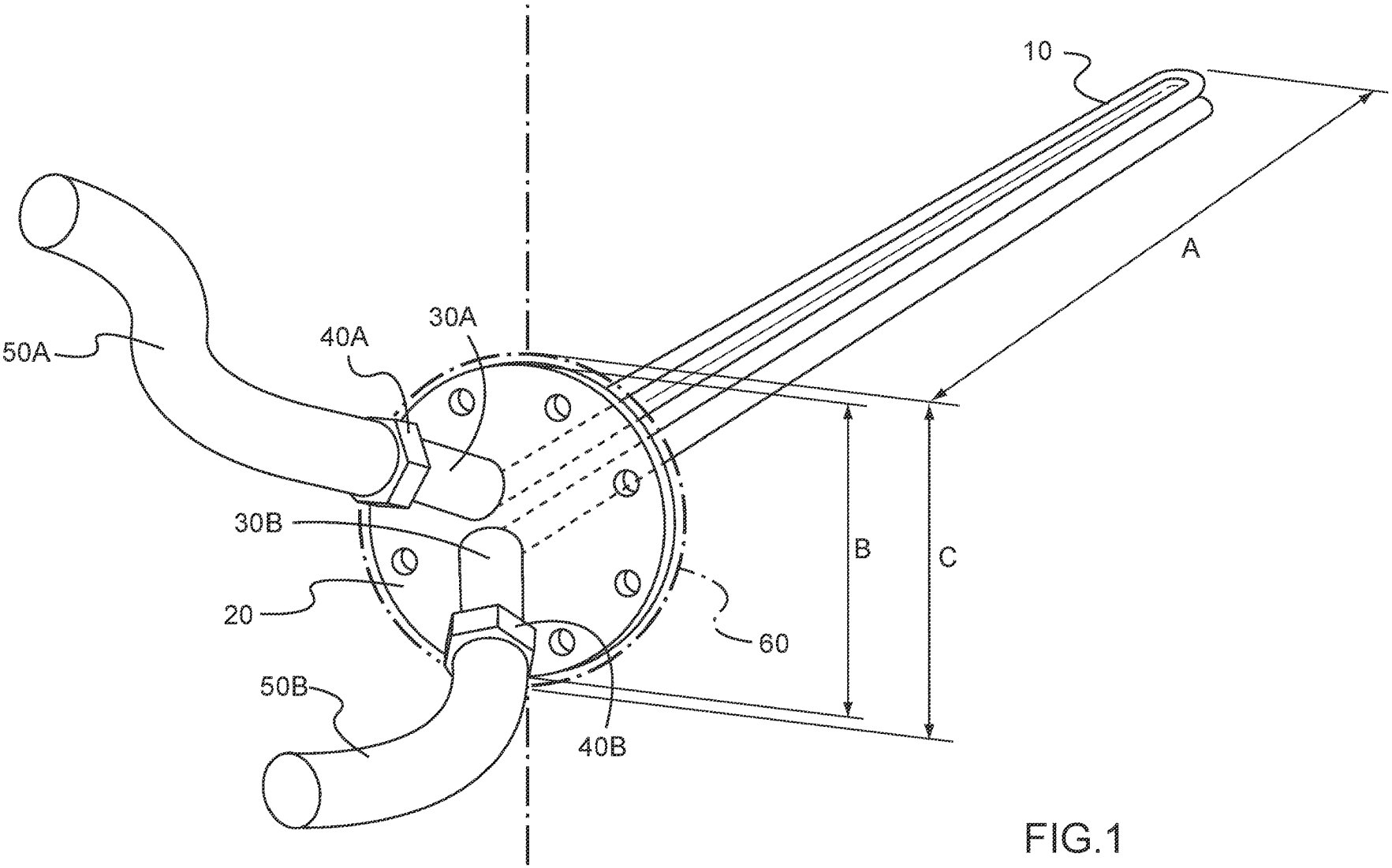
FIG. 1 is a drawing one embodiment of a heat exchanger.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein Reference will now be made to FIGS. 1 and 2, a more detailed description of the heat exchanger process. Each component will be described in detail, followed by an overview of the heat exchanger process.

The largest component of heat exchanger 1, for example, is heat transfer tube 10. In this example, heat transfer tube 10 (e.g., may be multiple tubes) is constructed of stainless steel (e.g., provides corrosion resistance for caustic fluids); however, it is known to use any similar non-corrosive material, such as steel, or copper. The heat transfer tube 10 can be constructed of varying sizes, mainly dependent on the flange size of the tank that it is inserted into. The heat transfer tube 10 may be configured to include one or more bends, depending, in part on the tank flange size.

Attached to the heat transfer tubes 10 is heat exchanger flange 20. In this example, heat exchange flange 20 is constructed of the same material as the heat exchanger tubes (e.g., stainless steel); however, it is known to use any similar non-corrosive material, such as steel, or copper. The heat exchange flange 20 is attached to or formed integral with the heat transfer tube 10. In this example, the heat exchange flange 20 is welded to the heat transfer tube 10. However, one of ordinary skill in the art would connect the flange 20 to the tube 10 in any safe and secure manner. In this example, the heat exchange flange 20 includes a plurality of through holes having a smaller diameter, for example, than an opening in the tank flange 60 described below. The through holes are configured to allow the heating fluid (e.g., hot glycol) to circulate to the heat transfer tubes 10.

Pipes 30A and 30B are attached to an opposite side of the heat exchanger flange 20 as the heat transfer tube 10.

The pipes 30A and 30B are attached to or formed integral with a surface of the heat exchanger flange 20. In this example, the pipes 30A and 30B are welded to the surface. Quick connect couplers 40A and 40B are attached to an end of the pipes 30A and 30B that is away from the surface of the heat exchanger flange 20. In this example, the quick connect couplers 40A and 40B are hydraulic quick connect couplers and are screwed on to the end of the pipes 30A and 30B. The quick connect couplers 40A and 40B are arranged between the pipes 30A and 30B and hoses 50A and 50B. The quick connect couplers 40A and 40B are configured to connect the hoses 50A and 50B to the pipes 30A and 30B in order to transfer a heated fluid (e.g., hot glycol) to the heat exchanger 1. The hoses 50A and 50B can be constructed of various dimensions and can be connected to other hoses or a heater with quick connect couplers, such as the type described above.

Figure 2:
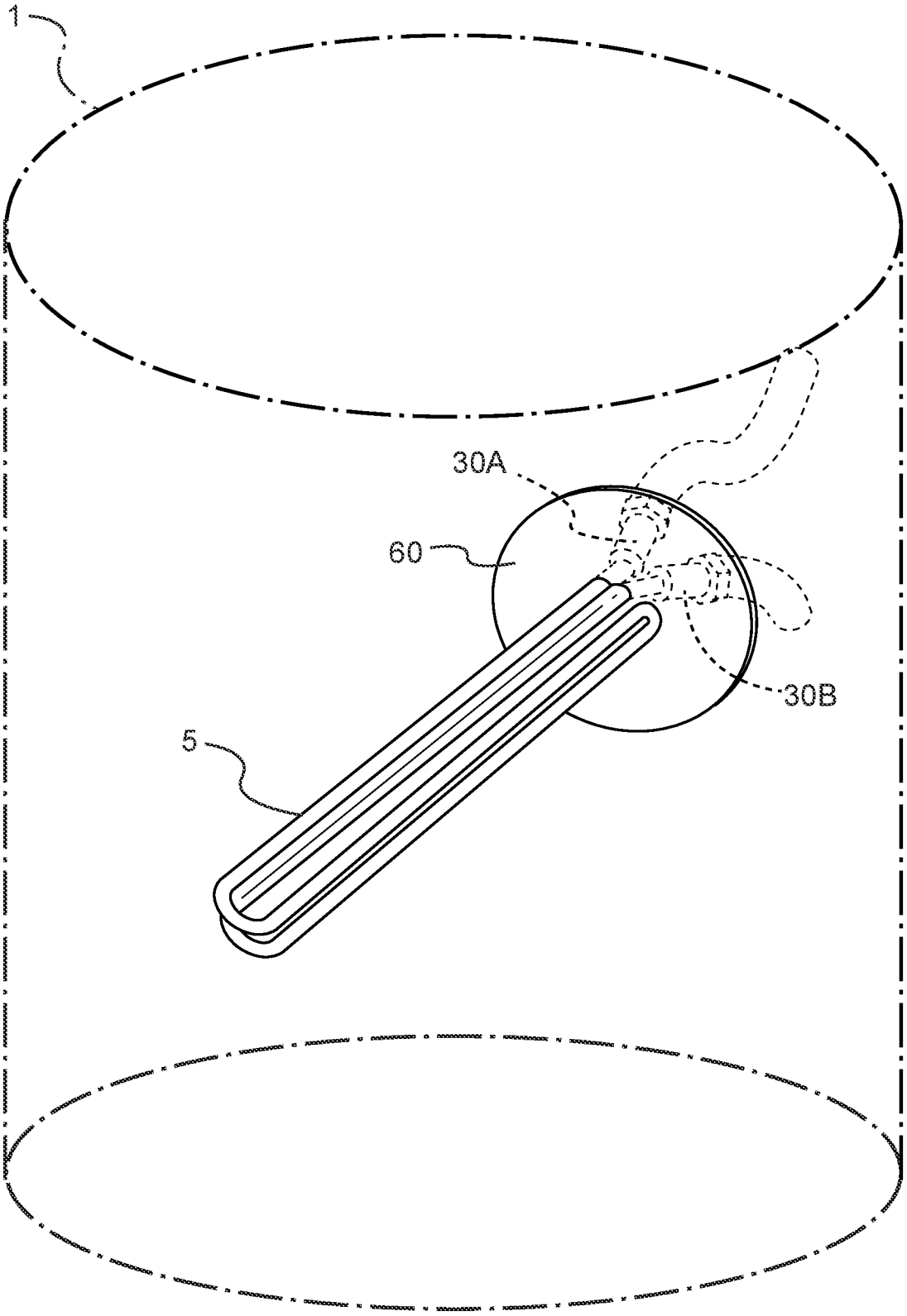
FIG. 2 is a drawing of one embodiment of a heat exchanger inside a tank.

Tank flange 60 is attached to or formed integral with a surface of tank 1 (e.g., drum), as shown in FIG. 2. In this example, the tank flange 60 is welded to the tank 1. The tank flange 60 may be configured of varying dimensions, preferably having a diameter approximately the same as that of the heat exchanger flange 20. In this example, the tank flange 60 has approximately the same diameter as the heat exchanger flange 20. An opening (through hole) is formed in the tank flange and is configured to accommodate the passage of the heat transfer tubes 10 into the tank 1. In this example, the opening is approximately four-inches in diameter. However, one of ordinary skill in the art would utilize varying sizes that are appropriate.

The tank flange 60 may include a pipe having the same diameter as the opening formed in the tank flange 60 and extending from the tank flange 60 into the tank 1. In this example, a bolt pattern formed on the tank flange 60 is designed to match a bolt pattern formed on the heat transfer flange 20 so that the tank flange 60 can be fixed to the heat transfer flange such that the heat transfer tubes 10 extend through the pipe of tank flange 60 and into the tank 1.

In this example, hot glycol travels through the hose 50A, which is connected to the quick connect coupler 40A and then flows into the drum through a first opening in the flanges 20, 60 to an inside of the heat transfer tube 10 arranged inside the drum. The glycol continuously flows inside the heat transfer tube 10 (e.g., generally u-shaped in this example) and exits the drum through a second opening in the flanges 20, 60 to the quick connect coupler 40B and then exits the heat exchanger through the hose 50B.

The process can be reversed so that either coupler can be a used as an intake or exit for the hot glycol. The hot glycol can be pumped through the heat exchanger continuously or intermittently as required.

Although an embodiment of the instant invention has been described above and illustrated in the accompanying drawing in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A method of connecting a heat exchanger apparatus to a tank, said heat exchanger apparatus comprising a flange and at least one heat transfer tube directly mounted on a first surface of the flange, opposing ends of each heat transfer tube arranged in fluid communication with a corresponding intake port and exit port extending through the flange, and said tank comprising a tank flange having an opening formed in a surface of said tank to an outside of said tank, the tank flange having approximately a same diameter as the flange of said heat exchanger apparatus, said method comprising, aligning the heat transfer tube such that the heat transfer tube extends inside said tank through the opening formed in the tank flange, mounting the first surface of the flange of the heat exchanger against the tank flange, and attaching the first surface of the flange of the heat exchanger to an outside surface of the tank flange, wherein the at least one heat transfer tube is configured to be in direct contact with material stored in said tank, and said heat exchanger apparatus is configured to be removable from said tank.

2. The method of connecting a heat exchanger apparatus to a tank recited in claim 1, further comprising:

transferring a heat transfer fluid through the heat transfer tube to heat the inside of said tank.

3. The method of connecting a heat exchanger apparatus to a tank recited in claim 1, wherein the at least one heat transfer tube comprises a substantially U-shaped tube, wherein a bend portion of the U-shaped tube is positioned away from the flange.

4. The method of connecting a heat exchanger apparatus to a tank recited in claim 3, wherein the bend portion of the U-shaped tube defines a first portion and a second portion, the first portion comprises a first one of the opposing ends of the at least one heat transfer tube, and the second portion comprises a second one of the opposing ends of the at least one heat transfer tube.

5. The method of connecting a heat exchanger apparatus to a tank recited in claim 1, comprising a single heat transfer tube bent in a plurality of U-shaped bend portions.

6. The method of connecting a heat exchanger apparatus to a tank recited in claim 5, the single heat transfer tube being bent in a first U-shaped bend portion thus defining first and second portions, the first portion comprising a first one of the opposing ends, the second portion comprising a second one of the opposing ends, the first portion being bent in a second U-shaped bend portion and second portion being bent in a third U-shaped bend portion, the first U-shaped bend portion positioned proximal to the flange, the second and third U-shaped bend portions positioned distal to the flange.

7. The method of connecting a heat exchanger apparatus to a tank recited in claim 1, wherein the at least one heat transfer tube is formed integrally with the flange.

8. The method of connecting a heat exchanger apparatus to a tank recited in claim 1, wherein the at least one heat transfer tube extends substantially perpendicularly from the flange.

9. The method of connecting a heat exchanger apparatus to a tank recited in claim 1, wherein the flange comprises a bolt pattern designed to overlap with a bolt pattern formed on the tank flange.

10. The method of connecting a heat exchanger apparatus to a tank recited in claim 1, wherein the through-hole is formed on a wall of said tank.

11. The method of connecting a heat exchanger apparatus to a tank recited in claim 1, wherein the at least one heat transfer tube is configured to have a heating fluid circulating through the at least one heat transfer tube.

12. A method of connecting a plurality of tank and heat exchanger apparatus combinations of claim 1, connected to one another in series or in parallel.

13. The method of connecting a heat exchanger apparatus to a tank recited in claim 1, further comprising:

detaching the first surface of the flange of the heat exchanger from an outside surface of the tank flange, and dismounting the first surface of the flange of the heat exchanger from the tank flange.

14. The method of connecting a heat exchanger apparatus to a tank recited in claim 1, wherein:

the heat exchanger is attached to the outside surface of the tank flange when said tank is empty.

15. The method of connecting a heat exchanger apparatus to a tank recited in claim 1, wherein:

when the tank is filled, a heating unit is connected to the heat exchanger, and hot liquid is circulated through the heat exchanger, pumped to the tank, and returned to the heater.

16. The method of connecting a heat exchanger apparatus to a tank recited in claim 15, wherein the heating process is continued until the material stored in the tank is heated to a predetermined temperature.

* * * * *